United States Patent [19]

Hymmen

[11] Patent Number: 4,656,716

[45] Date of Patent: Apr. 14, 1987

[54] HAND TOOL FOR BENDING AND STRAIGHTENING STUDS OF BOOKBINDING STRIPS

[75] Inventor: Karl Hymmen, Sparks, Nev.

[73] Assignee: VeloBind, Inc., Sunnyvale, Calif.

[21] Appl. No.: 776,207

[22] Filed: Sep. 16, 1985

[51] Int. Cl.[4] ..... B25B 27/00

[52] U.S. Cl. ..... 29/270

[58] Field of Search ..... 29/270, 278, 283.5, 29/235; 72/458, 479; 140/106, 123

[56] References Cited

U.S. PATENT DOCUMENTS

| | | | |
|---|---|---|---|
| 2,661,487 | 12/1953 | Hicks et al. | 29/270 X |
| 3,071,849 | 1/1963 | Krohm | 29/270 |
| 3,550,242 | 12/1970 | Sarvay et al. | 29/235 |
| 4,336,706 | 6/1982 | Garcia | 72/479 |

*Primary Examiner*—Frederick R. Schmidt
*Assistant Examiner*—Steven P. Schad
*Attorney, Agent, or Firm*—Julian Caplan

[57] ABSTRACT

A tool for use with a type of bookbinding strips wherein one strip is formed with bendable studs and the second strip is formed with holes and grooves in one surface extending away from the holes. The grooves are preferably formed with overhanging top longitudinal edges so that the studs, after passing through holes in the pages of the book and the holes in the second strip may be bent down into the grooves, snapping under the overhanging edges. The tool of this invention may be gripped at one end and drawn along the top of the second strip, bending the studs down into the channel. For this purpose, the end is curved and also recessed to receive the second strip. To bend the studs upward to debind the book, the tool is also formed with a shallow slot having a protrusion therein formed on one or opposite sides with depressions into which the pointed end of a stud may fit. By pulling the tool away from the second strip, the stud is bent upward to approximately its original position.

6 Claims, 6 Drawing Figures

HAND TOOL FOR BENDING AND STRAIGHTENING STUDS OF BOOKBINDING STRIPS

CROSS-REFERENCE TO RELATED APPLICATIOON

Reference is made to application Ser. No. 663,214, filed Oct. 22, 1984, for bookbinding strips and method of binding books. The tool of the present invention is used with such strips.

BACKGROUND OF THE INVENTION

This invention relates to a tool used to bend over flexible studs projecting from one of a pair of bookbinding strips. The tool also has provision for engaging the bentover studs and pulling them upright.

DESCRIPTION OF RELATED ART

Means for bending over and bending upward flexible studs are shown in said patent application Ser. No. 663,214. The present invention comprises an improvement thereon.

SUMMARY OF THE INVENTION

The tool of the present invention is shaped to be conveniently gripped in the hand. One end is curved and is formed with a depression dimensioned so that the tool may be drawn over the top of a female binding strip of the type described herein. As the tool moves along the strip, it encounters the bendable studs projecting therethrough and bends the same over, forcing them into grooves in the upper surface of the female strip. Because of the groove formed in the curved end of the tool, the tool follows the strip effectively.

If it is necessary to unbind the book, in order to displace the bentover studs from the grooves in which they have been forced, a notch is formed in one location in a side edge of the tool, the notch being shaped to fit transversely across the female strip. There is a protrusion in the notch formed with depressions, preferably oppositely facing. With the tool extending transversely across the female strip and the protrusion extending into the groove, the tool is drawn toward the end of the stud, until the latter seats in one of the depressions in the protrusion. By then pulling the tool away from the female strip, the stud may be bent upward.

Accordingly, the invention provides a convenient means both for bending the studs downwardly and bending them upwardly and is characterized by the fact that it may be conveniently manipulated by the user.

Other objects of the present invention will become apparent upon reading the following specification and referring to the accompanying drawings in which similar characters of reference represent corresponding parts in each of the several views.

In the drawings:

FIG. 1. is a plan view of a tool in accordance with the present invention;

DESCRIPTION OF PREFERRED EMBODIMENT

Figure 1:
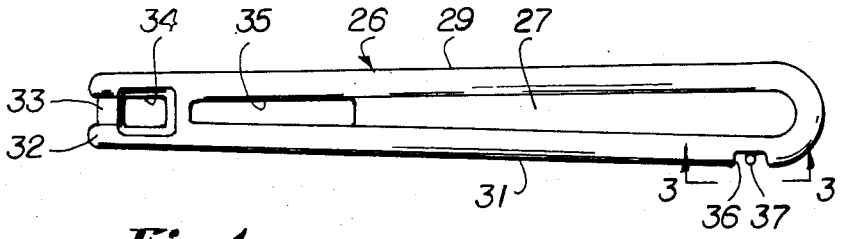

As is explained in greater detail in said application Ser. No. 663,214, in order to bind a document, a male strip 11 is provided having at longitudinally spaced intervals flexible studs 12 having pointed ends 13. Preferably, the strip 11 is molded of a plastic material such as polyvinylchloride. Cooperating with strip 11 is a second strip 16 formed with holes 17 at the same intervals as the studs 12 and dimensioned to received said studs. Communicating with each hole 17 and extending in one direction away therefrom is a groove 18 formed in the top surface of strip 16. Preferably, the longitudinal edges 19 of groove 18 overhang so that studs 12 may be snapped between the overhanging longitudinal edges 19. In order to bind a document, the studs 12 are passed through holes in paper 21 and through the holes 17. They are then bent over as indicated by reference numeral 22 into the grooves 18 and held in place by the longitudinal edges 19.

Occasionally, it is necessary to disassemble a book in order to add, remove or substitute pages 21. In order to accomplish this result, the bent over ends 22 are snapped out of the grooves 18 and bent to approximately upright position permitting removal of the strip 16 and such of the sheets 21 as required.

Figure 2:
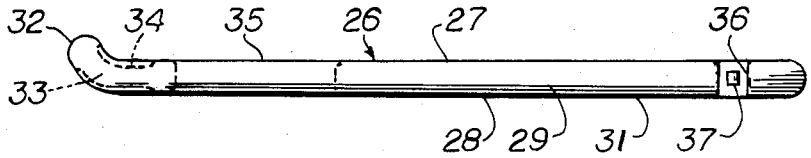
FIG. 2 is a side elevational view thereof.
Figure 4:
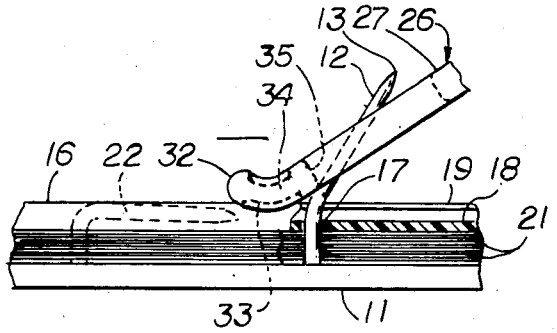
FIG. 4 is an enlarged fragmentary sectional view showing use of the tool to bend over studs.
Figure 3:
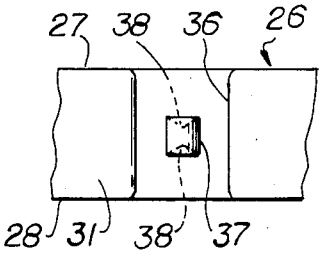
FIG. 3 is an enlarged fragmentary elevational view taken substantially along the line 3—3 of FIG. 1.

Tool 26 is used to bend over the studs 12 and also to remove the bent studs 22. Tool 26 has a top surface 27 and a bottom surface 28 and first and second longitudinal edges 29, 31. The first end 32 of tool 26 is curved as best shown in FIG. 2 and the curved portion is formed with an end slot 33, the width of which equals the width of strip 16. Adjacent the end slot 33 is a thumb depression 34, in which a finger or thumb may be placed to facilitate applying downward force while sliding the tool along strip 16. Thus, as shown in FIG. 4, the tool 26 is held so that the curved end 32 engages the top of strip 16, the strip being received in the slot 33. By pulling the tool 26 along to the right as viewed in FIG. 4, each of the studs 12 is bent over to the position shown as reference numeral 22, the studs snapping between the edges 19 and being held in place. to facilitate this operation, a hole 35 may be formed in the tool into which studs 22 may enter until they reach the position to be bent over.

Slot 36 is formed in side edge 31, the width of the slot being equal to the width of the strip 16. The depth of the slot is approximately equal to the depth of the groove 18. Extending into the slot 36 is a projection 37 and on either face of projection 37 is a conical depression 38.

Figure 5:
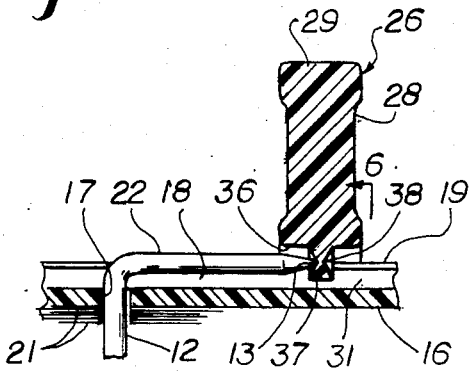
FIG. 5 is a fragmentary sectional view showing use of the tool to debind studs.
Figure 6:
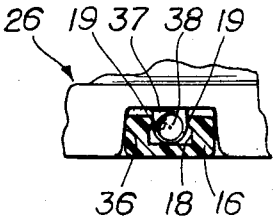
FIG. 6 is a fragmentary sectional view taken substantially along the line 6—6 of FIG. 5.

As best shown in FIGS. 5 and 6, in order to bend bentover studs 22 upright, the tool is placed extending transversely of strip 16 with projection 37 extending into the groove 18. The pointed end 13 fits into one of the depressions 38. By pulling the tool 26 upwardly and to the left as viewed in FIG. 5, The point 13 sticking into the depression 38 is bent upwardly. Thereupon the stud may be bent into full upright position either using the tool 26 or the fingers. Strip 16 is then removed, whereupon the sheets 21 may be changed as required. Thereupon, the book may be rebound by replacing the strip 16 and bending the studs downwardly by use of the tool 26 as before.

What is claimed is:

1. A hand tool for use in binding a book of the type formed of a first strip having flexible studs upstanding therefrom at spaced intervals, sheets apertured to receive said studs, and a second strip formed with holes spaced at the same intervals as said studs to receive said studs and having an outer face formed with grooves extending longitudinally of said second strip, said tool having a handle extending along the longitudinal axis of said tool and having broad top and bottom surfaces and narrow sides, and a distal end having a tip formed curved upward about an axis transverse to and spaced above said longitudinal axis, said distal end being formed with a slot of a width slightly greater than the width of said second strip, said slot originating on said bottom adjacent said tip and curving along said tip to said top adjacent said tip, the bottom of said slot being flat, so that said tool may be positioned with said second strip received in said slot and said outer face engaging said bottom of said slot, said tool being formed with a window located rearward of said slot shaped to receive studs before they are bent, said window having a width approximately equal to the width of said slot and having a length extending longitudinally of said tool approximately the length of said studs, said lastnamed length being approximately twice the length of said tool forwardly of said window, said window having a forward edge, the intersection of said forward edge of said window and said bottom surface forming a corner to engage a stud extending up through said second strip and into said window to bend said stud down through said window as said tool is drawn rearwardly whereby said tool may be drawn along said second strip to sequentially engage said studs and bend each said stud into a groove.

2. A hand tool for use in binding and debinding a book of the type formed of a first strip having flexible studs upstanding therefrom at spaced intervals, said studs having points at their outer ends, sheets apertured to receive said studs, and a second strip formed with holes spaced at the same intervals as said studs to receive said studs and having an outer face formed with grooves extending longitudinally of said second strip, said tool having a handle and a distal end formed with a transverse slot of a width slightly greater than the width of said second strip, the bottom of said slot being flat, so that said tool may be positioned with said second strip received in said slot and said outer face engaging said bottom of said slot, whereby said tool may be drawn along said second strip to sequentially engage said studs and bend each said stud into a groove, said tool further having an edge formed with a second slot of the width of said second strip and a depth less than the thickness of said second strip, means in said second slot positioned to engage a point of one of said studs when said second slot straddles said second strip and said means enters a groove in said second strip and engages the point of a stud in said groove whereby pulling said tool away from said second strip said stud is at least partially straightened.

3. A tool according to claim 2 in which said tool is formed with a longitudinally extending window spaced from said slot, whereby said studs may extend into said window before being bent by said tool.

4. A tool according to claim 2 in which the top of said tool is formed with a depression spaced from said distal end shaped to receive a finger or thumb to apply downward pressure on said tool against said second strip.

5. A tool according to claim 2 in which said means comprises a protrusion from the middle of the bottom of said second slot formed with a depression shaped to receive one said point.

6. A tool according to claim 5 in which said protrusion is formed with a second depression directed oppositely to said first mentioned depression.

* * * * *